US005583622A

United States Patent [19]

Nishimura

[11] Patent Number: 5,583,622

[45] Date of Patent: Dec. 10, 1996

[54] DEVELOPING APPARATUS HAVING A LIMITING MEMBER FOR LIMITING AND SEPARATING A TIP OF A DEVELOPER BRUSH

[75] Inventor: Ryouji Nishimura, Osaka, Japan

[73] Assignee: Mita Industrial Co., Ltd., Japan

[21] Appl. No.: 400,949

[22] Filed: Mar. 9, 1995

[30] Foreign Application Priority Data

Mar. 15, 1994 [JP] Japan ..... 6-044239

[51] Int. Cl.[6] ..... G03G 15/09

[52] U.S. Cl. ..... 355/251; 118/657; 355/245

[58] Field of Search ..... 355/245, 251, 355/253; 118/656, 657, 658

[56] References Cited

U.S. PATENT DOCUMENTS

| | | | |
|---|---|---|---|
| Re. 34, 724 | 9/1994 | Hosono et al. | 118/657 |
| 4,660,958 | 4/1987 | Egami et al. . | |
| 4,887,131 | 12/1989 | Kinoshita et al. | 355/253 |
| 4,912,513 | 3/1990 | Oka et al. | 355/253 |
| 5,034,773 | 7/1991 | Nimura et al. | 118/657 X |
| 5,097,295 | 3/1992 | Tanaka | 355/253 X |
| 5,119,758 | 6/1992 | Inoue et al. | 118/658 |
| 5,187,523 | 2/1993 | Osawa | 355/251 |
| 5,239,343 | 8/1993 | Sakemi et al. | 355/253 |

FOREIGN PATENT DOCUMENTS 0364007 4/1990 European Pat. Off. .

OTHER PUBLICATIONS

Patent Abstract of Japan, vol. 10, No. 34 (p–427), Feb. 8, 1986 (Abstract of Japanese Patent Publication No. 60–181754, to Mita Kogyo, published Sep. 17, 1985).

*Primary Examiner*—Sandra L. Brase
*Attorney, Agent, or Firm*—Beveridge, DeGrandi, Weilacher & Young, L.L.P.

[57] ABSTRACT

The present invention is directed to the provision of a developing apparatus that can prevent copy quality degradation. The invention comprises a developing sleeve for supplying toner to a photoconductor drum surface, and a brush-thickness control member disposed in close proximity to the developing sleeve. The invention further includes limiting device, disposed adjacent to and upstream of the brush-thickness control member with reference to the rotating direction of the developing sleeve, for limiting the advance of the tip of an erected developer brush by pushing the tip toward the upstream side. Furthermore, there is provided, substantially below the limiting device, a guide end portion for receiving the whole or part of the developer limited by the limiting device and separated from the erected developer brush and for guiding the received developer in a direction moving away from the developing sleeve.

16 Claims, 8 Drawing Sheets

DEVELOPING APPARATUS HAVING A LIMITING MEMBER FOR LIMITING AND SEPARATING A TIP OF A DEVELOPER BRUSH

BACKGROUND OF THE INVENTION

1. Field of the Invention

The present invention relates to a developing apparatus for use in an image forming apparatus.

2. Related Art of the Invention

In the prior art, it is known to provide a recirculating-type developing apparatus in an image forming apparatus, such as a copying machine, employing a two-component developing method. In one such developing apparatus 200 shown in FIG. 8, two transport screws 201 for mixing and transporting developer are rotatably mounted with a partition wall 202 interposed therebetween, and a toner density detect sensor 204 is located in a sidewall 203 of the developing apparatus 200 in close proximity to one of the transport screws 201. The toner density detect sensor 204 is designed to detect the toner density of the developer carried on the transport screw 201. FIG. 8 given here shows a side structural view of the recirculating-type developing apparatus 200, with certain parts omitted for clarity.

In this developing apparatus 200, the developer transported by the transport screws 201, etc. is continually distributed to the surface of a developing sleeve 205, and as the developing sleeve 205 rotates (in the direction shown by arrow in the figure), the thickness of the developer on it is adjusted by means of a doctor blade 206 before the developer is brought into contact with the surface of a photoconductor drum 207. Then, a toner image is formed on the surface of the photoconductor drum 207.

The above construction, however, has had the shortcoming that when the developing apparatus 200 has been used for long periods of time, the same toner particles tend to remain adhering to the surface of the developing sleeve 205, making it difficult to apply the necessary toner to the surface of the photoconductor drum 207 and thus degrading the intended function of the developing sleeve 205. This results in a degradation in copy quality of the copying machine.

In view of the above problem of the prior art developing apparatus, it is an object of the present invention to provide a developing apparatus that can prevent copy quality degradation.

SUMMARY OF THE INVENTION

According to the present invention, there is provided a developing apparatus comprising: a developing sleeve for supplying toner to a photoconductor surface; a brush-thickness control member disposed in close proximity to the surface of the developing sleeve; and limiting means, disposed adjacent to and upstream of the brush-thickness control member with reference to the rotating direction of the developing sleeve, for limiting the advance of the tip of an erected developer brush by pushing the tip toward the upstream side.

In the present invention, the developing sleeve supplies toner to the photoconductor surface, the brush-thickness control means is disposed in close proximity to the surface of the developing sleeve, and the limiting means is disposed adjacent to and upstream of the brush-thickness control member with reference to the rotating direction of the developing sleeve and limits the developer brush tip by pushing it toward the upstream side. As a result, the brush tip pushed toward the upstream side is separated from the developer brush.

BRIEF DESCRIPTION OF THE DRAWINGS

FIG. 1 is an external perspective view of a copying machine incorporating a toner hopper and a developing apparatus according to one embodiment of the present invention.

FIG. 2 is a cross-sectional view of the copying machine, with certain parts omitted, showing the developing apparatus and its adjacent parts according to the same embodiment.

FIG. 3 is a transverse cross-sectional view taken along line $Y_1$–$Y_2$, showing the construction of the developing apparatus according to the same embodiment.

FIG. 4 is a cross-sectional perspective view showing a guide end portion and its adjacent parts according to the same embodiment.

FIG. 6 is a cross-sectional view of a developing apparatus incorporating a limiting means having a sloped face instead of a step.

FIG. 8 is a side structural view of a prior art recirculating-type developing apparatus, with certain parts omitted.

DESCRIPTION OF THE REFERENCE NUMERALS

1 . . . Copying machine, 5 . . . Toner hopper, 6 . . . Developing apparatus, 7 . . . Toner cartridge, 9 . . . Limiting means, 9*a* . . . Step, 10 . . . Guide portion, 10*a* . . . Elongated opening, 10*c* . . . Guide end portion, 41 . . . First transport screw, 102*a* . . . Toner chamber, 104 . . . Toner, 105 . . . Supply hole, 106 . . . Screw conveyer, 107 . . . Plate-like toner-transport member, 206 . . . Doctor blade, 205 . . . Developing sleeve

DESCRIPTION OF THE PREFERRED EMBODIMENTS

The preferred embodiments of the present invention will now be described below with reference to the accompanying drawings.

Figure 1:
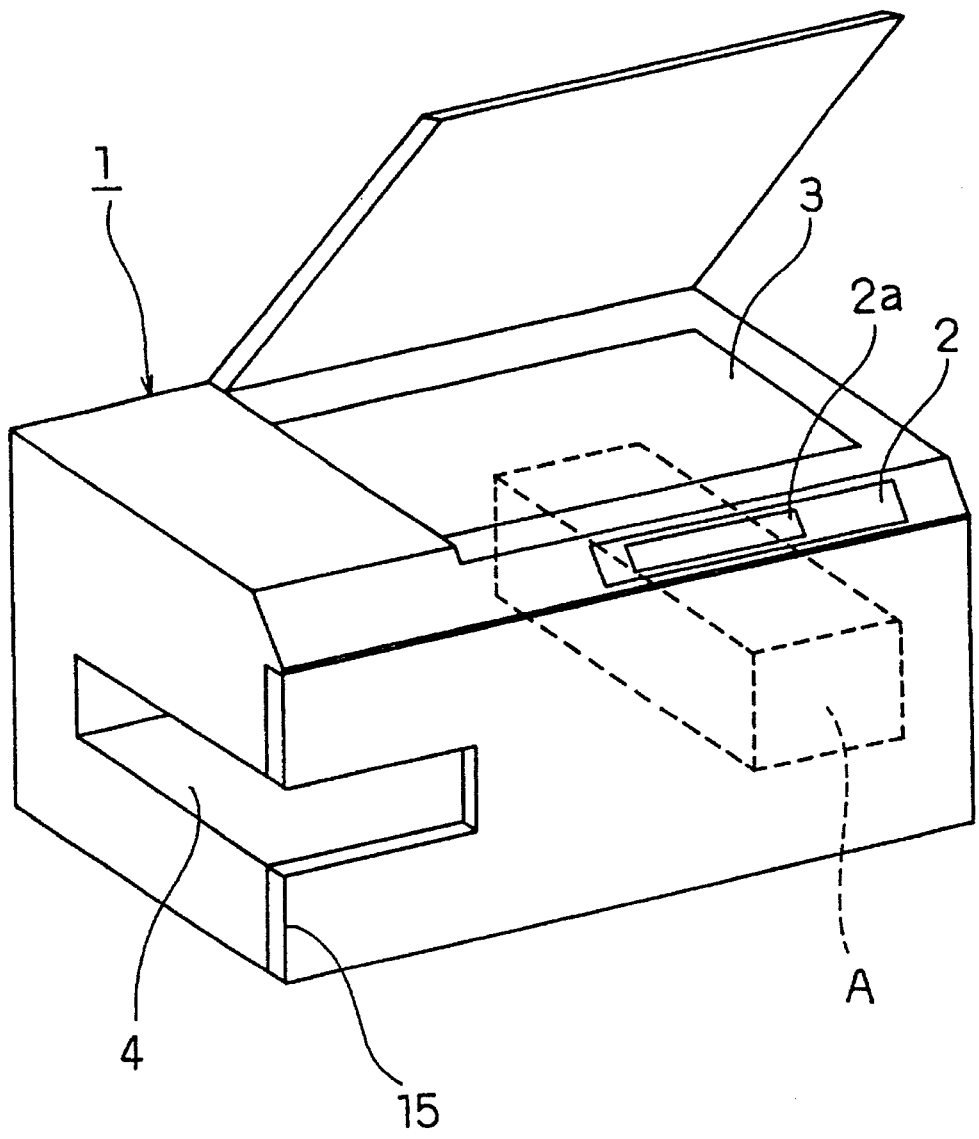
[FIG. 1]
Figure 2:
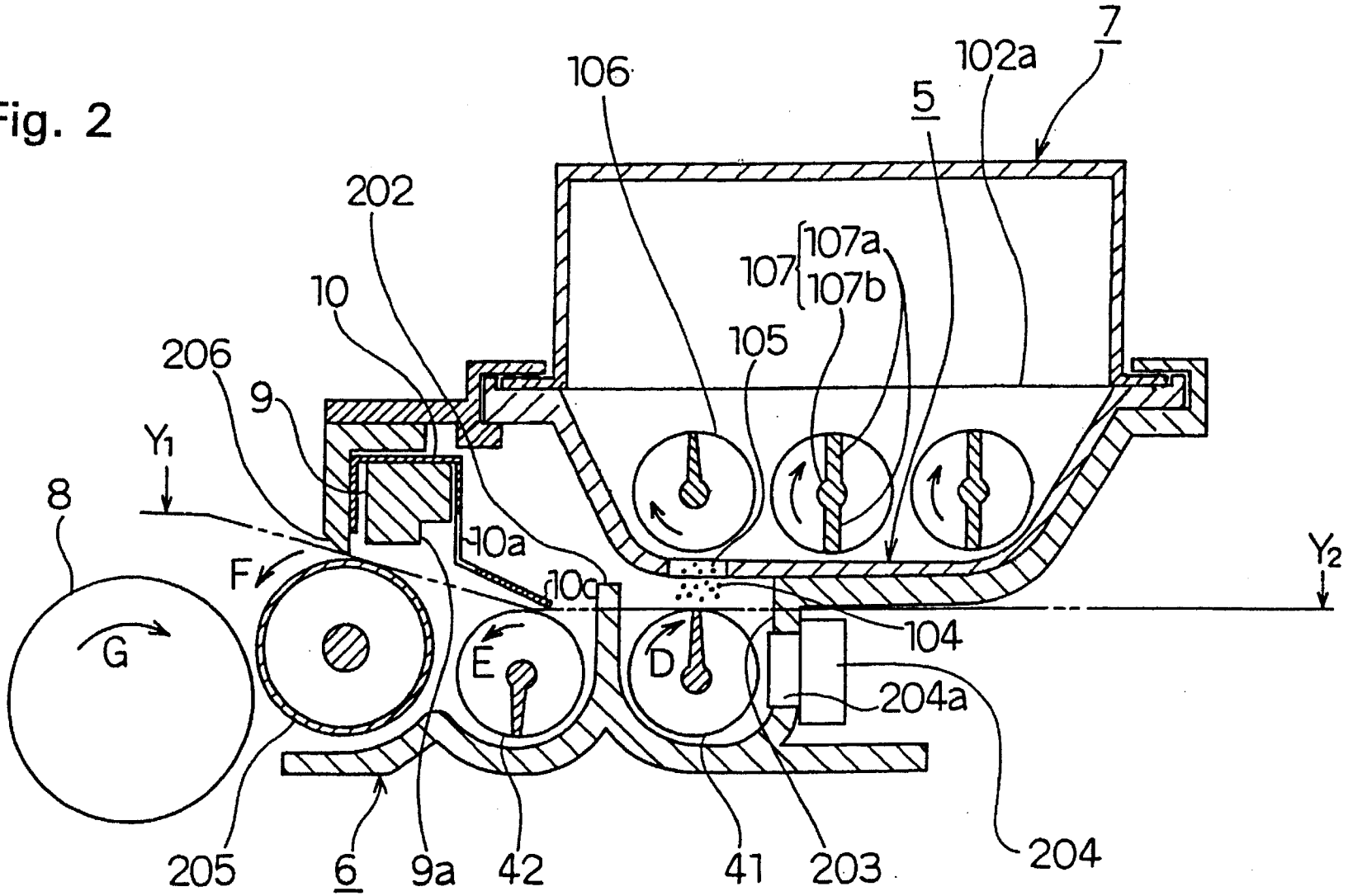
[FIG. 2]
Figure 8:
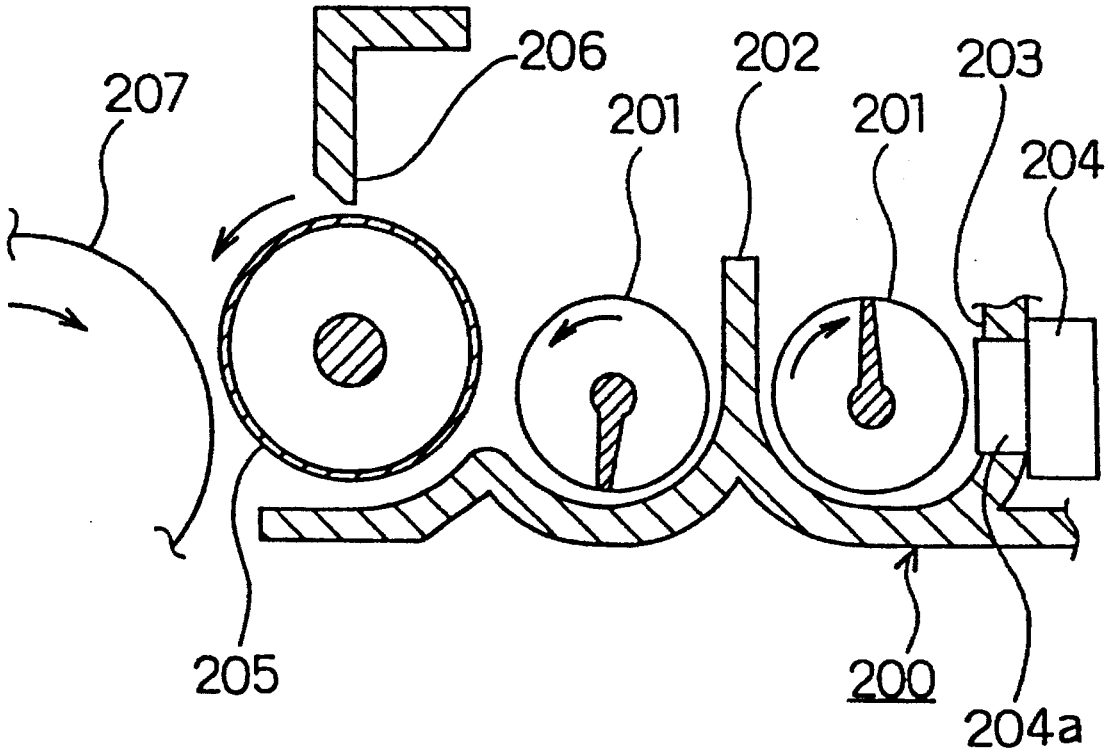
Fig. 8 (Prior Art)
[FIG. 8]

FIG. 1 is an external perspective view of a copying machine incorporating a developing apparatus according to one embodiment of the invention. FIG. 2 is a cross-sectional view of the copying machine, with certain parts omitted, illustrating mainly the developing section for explaining the construction of the present embodiment. A detailed description of the construction of the present embodiment will be given below with reference to FIG. 2 and other drawings, wherein corresponding parts to those shown in FIG. 8 are designated by like reference numerals.

As shown in FIG. 1, the copying machine 1 has an operation part 2 and a display part 2*a* on its front upper panel, a document glass 3 on its top surface, and a paper exit 4 in its left side panel through which copy paper exits after a copy process. A toner hopper 5, a developing apparatus 6, a toner cartridge 7, etc., hereinafter described in one embodiment of the invention, are constructed substantially in an integral unit (section A indicated by dotted lines in the figure) which is located in the center of the right-hand part of the copying machine 1. The front panel 15 is installed in such a manner that it can be opened to allow the operator to access the toner cartridge 7 and other components for replacement and maintenance.

In FIG. 2, the toner hopper 5 is located adjacent to and upwardly of the developing apparatus 6, and above the toner hopper 5, the toner cartridge 7 is mounted slidably so that it can be accessed for replacement from the front side of the copying machine 1.

In the bottom of a toner chamber 102*a* inside the toner hopper 5, there is formed a supply hole 105 through which toner 104 is supplied to the developing apparatus 6. The supply hole 105 is located near the front side of the copying machine 1 (the foreground side in FIG. 1) and directly above a first transport screw 41, hereinafter described, installed in the developing apparatus 6. Above the supply hole 105, a screw conveyer 106 is rotatably mounted inside the toner chamber 102*a*. Further, two plate-like toner-transport members 107, each having a pair of longitudinally extending plate-like blades, are rotatably mounted and substantially parallel to the screw conveyer 106 (see FIG. 2).

On the other hand, in the developing apparatus 6, the first transport screw 41 and second transport screw 42, from right in the figure, are rotatably mounted parallel to each other with a partition wall 202 interposed therebetween; with the rotation of the first and second transport screws 41 and 42 (the directions of rotation are respectively shown by arrows D and E in FIG. 2), the fresh toner 104 supplied through the supply hole 105 located thereabove is transported and mixed with the developer circulating in the developing apparatus 6. A toner density detect sensor 204 is mounted in a sidewall 203 of the developing apparatus 6.

Adjacent to the second transport screw 42 is mounted rotatably a developing sleeve 205 (rotatable in the direction shown by arrow F in FIG. 2), in close proximity to which a photoconductor drum 8 is rotatably mounted (rotatably in the direction shown by arrow G in the figure).

Located above the developing sleeve 205 is a doctor blade 206, a brush-thickness control member in the present invention, adjacent to which there is disposed a limiting means 9 having a step 9*a* on the side thereof facing the developing sleeve 205. The limiting means 9 has a slightly longer length than that of the developing sleeve 205, and is mounted substantially parallel to the axis of rotation of the developing sleeve 205. Further, a guide portion 10 having an elongated opening 10*a* of prescribed shape is attached in an encircling relationship to the limiting means 9. The length of the developing sleeve 205 mentioned above is the dimension measured along its axis of rotation.

Figure 4:
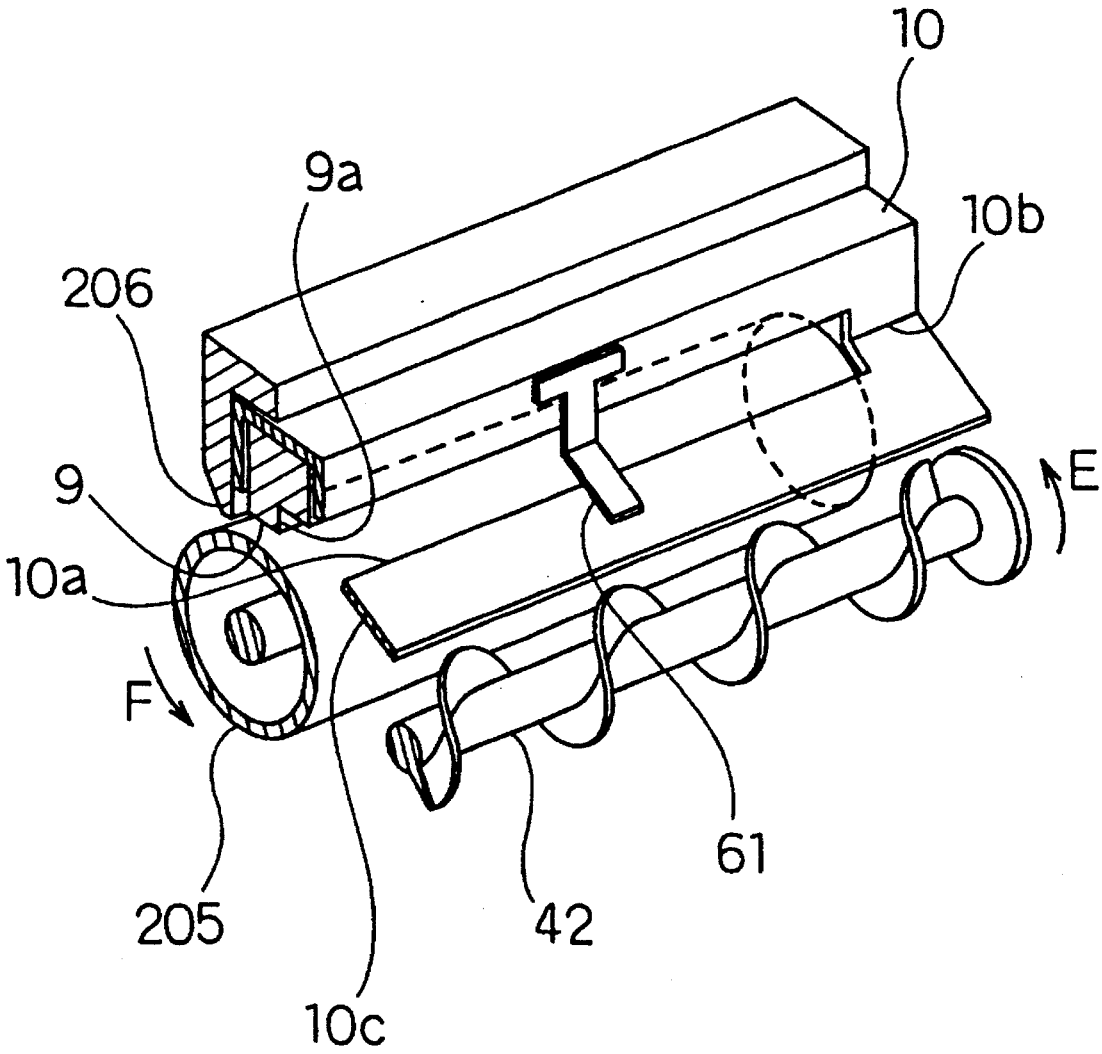
[FIG. 4]

Next, the limiting means 9, the guide portion 10, and their adjacent parts will be described in further detail with reference to FIG. 4. FIG. 4 is a cross-sectional perspective view showing in detail the guide portion 10 and its adjacent parts.

As shown, the step 9*a* of the limiting means 9 is provided so that the developer brush formed on the surface of the developing sleeve 205 is effectively caused to bow.

The guide portion 10 is longer than the developing sleeve 205, and the elongated opening 10*a* formed along a bent portion 10*b* is made to have substantially the same length as that of the developing sleeve 205. A plurality of reinforcing plates 61 are spot welded across the elongated opening 10*a* to prevent the deformation of the elongated opening 10*a* and its adjacent areas.

The longitudinal direction of the elongated opening 10*a* coincides with the direction of the rotational axis of the developing sleeve 205. The length of the elongated opening 10*a* mentioned above is the dimension measured along its longitudinal direction.

A guide end portion 10*c*, which forms part of the guide portion 10, extends slightly downward of the bent portion 10*b*, moving away from the developing sleeve 205, passing the crest of the second transport screw 42, and reaching a position near the partition wall 202 (see FIG. 2). The guide member described in claim 2 of the invention includes the guide end portion 10*c*.

The limiting means 9 and the guide portion 10 must be formed from non-magnetizable materials. An ABS resin is used for the former and a stainless steel for the latter.

In the above construction, the operation of the present embodiment will be described below with reference to relevant drawings.

As shown in FIG. 2, fresh toner 104 drops through an opening in the toner cartridge 7 mounted above and adjacent to the toner hopper 5, and falls into the toner chamber 102*a*. Then, with the rotation of the screw conveyer 106, etc., the fresh toner 104 is supplied to the developing apparatus 6 through the supply hole 105.

Figure 3:
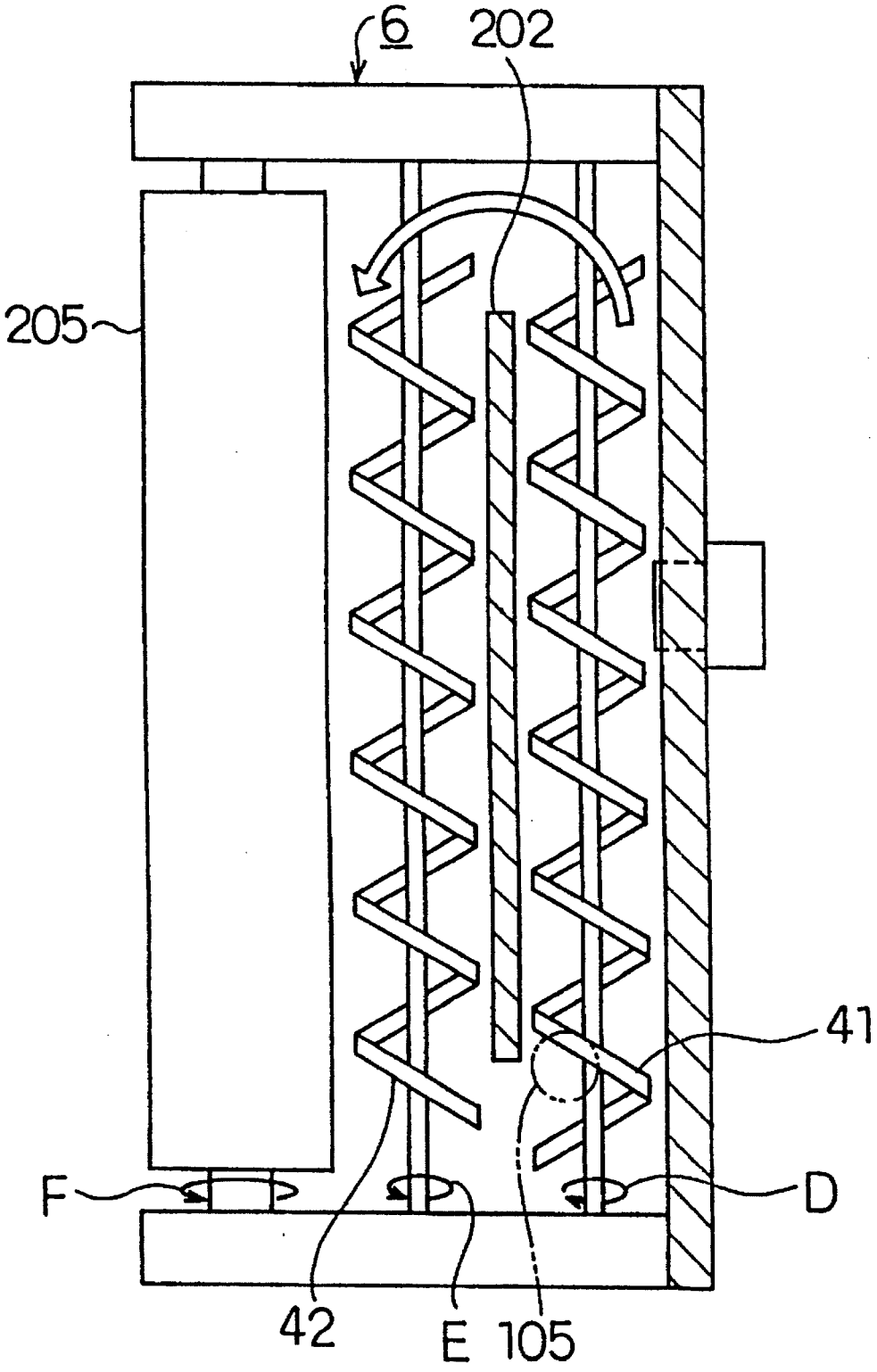
[FIG. 3]

When the fresh toner 104 is supplied to the developing apparatus 6, the first transport screw 41 rotates in the direction of arrow D, as shown in FIG. 3, thereby transporting the developer in the direction indicated by a thick arrow shown in the figure while mixing the developer or mixing the fresh toner 104, replenished through the supply hole 105, into the circulating developer. Shown in FIG. 3 is a transverse section taken substantially along line $Y_1$–$Y_2$ in FIG. 2.

On the other hand, the second transport screw 42 rotates in the direction shown by arrow E, to further agitate the developer transported from the first transport screw 41, and supplies part of the fresh developer to the developing sleeve 205 which is rotating in the direction shown by arrow F. The fresh developer thus supplied is subjected to prescribed adjustments by the limiting means 9, the doctor blade 206, etc., as will be described later, and as the developing sleeve 205 rotates, the developer is brought into contact with the photoconductor drum 8 mounted in close proximity to the developing sleeve 205 (see FIG. 2). The surface of the photoconductor drum 8 is developed with the toner particles in the fresh developer distributed to the photoconductor drum 8. The used developer is further carried with the rotation of the developing sleeve 205 rotating in the prescribed direction, and is subsequently separated from the developing sleeve 205 and collected by the second transport screw 42 for transportation back to the first transport screw 41.

Figure 5A:
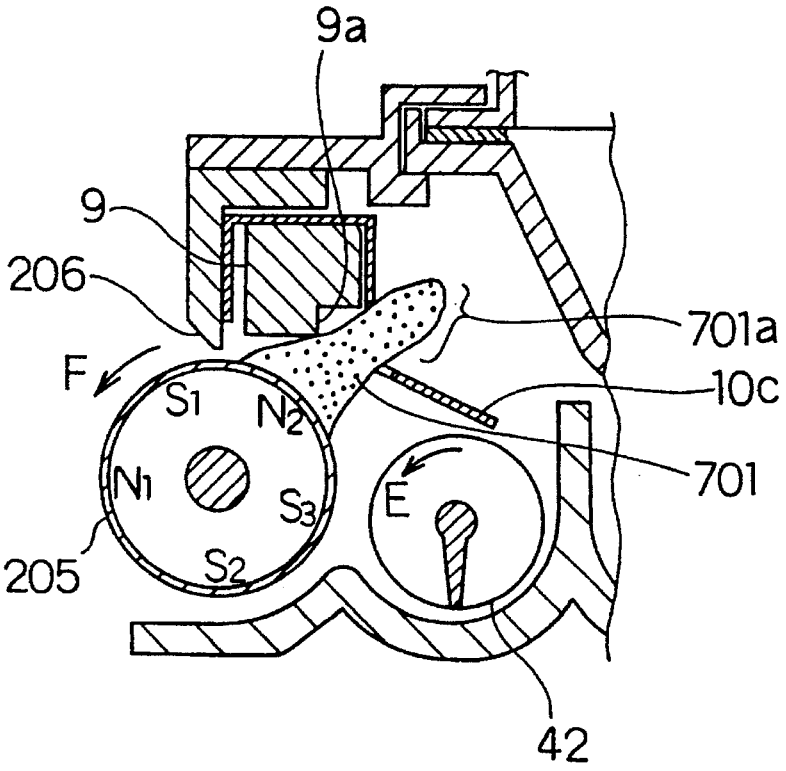
[FIG. 5] FIG. 5(*a*) is a cross-sectional view showing how the magnetic brush formed on the surface of a developing sleeve is deformed according to the same embodiment, and FIG. 5(*b*) is a cross-sectional view showing how a portion of the magnetic brush formed on the surface of the developing sleeve is separated and drops according to the same embodiment.
Figure 5B:
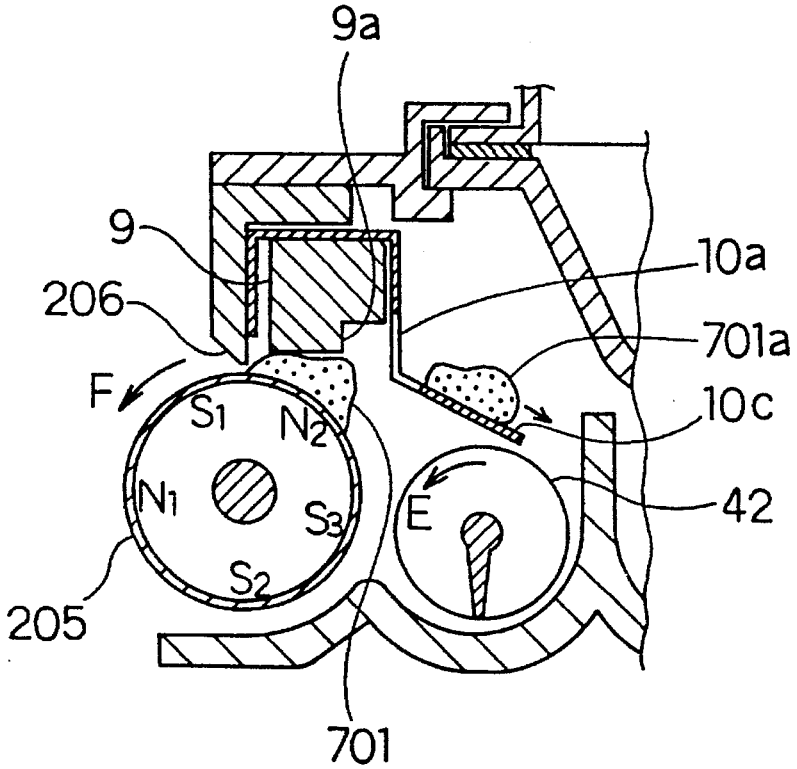

Referring now to FIG. 5(*a*), the fresh toner supplied to the developing sleeve 205 is attracted by the magnetic force of the magnet roller (not shown) enclosed in the developing sleeve 205 and forms a magnetic brush 701, the developer brush in the present invention, on the surface of the developing sleeve 205.

However, the tip portion 701*a* of the magnetic brush 701 carried with the rotation of the developing sleeve 205 in direction F is prevented from advancing further by the presence of the limiting means 9 (see FIG. 5(*a*)), and is slantingly stretched passing through the elongated opening 10*a* in the guide portion 10. When the developing sleeve 205 rotates further, the tip portion 701*a* that has been pushed and stretched outside the attraction region of the magnet roller is separated from the other portion of the magnetic brush 701 and drops onto the guide end portion 10*c* extending with a downward slope toward the partition wall 202.

The tip portion 701*a* thus separated is returned to the second transport screw 42 for mixing with the developer being transported. The purpose of the step 9*a* formed in the limiting means 9 is to effectively push the magnetic brush 701 and remove the separable tip portion 701*a* as much as possible. Here, FIG. 5(*a*) illustrates how the magnetic brush formed on the surface of the developing sleeve 205 is deformed, and FIG. 5(*b*) shows how a portion of the magnetic brush formed on the surface of the developing sleeve 205 is separated and drops.

Next, the magnet roller enclosed in the developing sleeve 205 and acting to form the magnetic brush 701 will be described in further detail with reference to FIG. 5(*a*).

In FIG. 5(*a*), five magnets are shown which are fixed in an unmovable manner inside the developing sleeve 205. The magnetic pole strengths of these magnets are as follows.

$N_1$: 850±50 (gauss), $N_2$: 500±50 (gauss), $S_1$: 540±50 (gauss), $S_2$: 530±50 (gauss), and $S_3$: 500±50 (gauss). Here, $N_1$ and $N_2$ are N poles, and $S_1$–$S_3$ are S poles.

It is clear from the previous description that the limiting means 9 is positioned within an area (the natural brush-forming area) where the developer brush would be formed by the rotation of the developing sleeve 205, the magnetic force of the magnets, etc. if it were not for the limiting means 9.

Accordingly, the developer brush formed on the surface of the developing sleeve 205 containing the above-constructed magnet roller is pushed toward the upstream side of the natural brush-forming area, as already described, because of the presence of the limiting means 9 positioned within the natural brush-forming area (see FIG. 5(*a*)).

The construction is such that when the developing sleeve 205 is rotating, the developer brush rises the highest on the outer circumferential surface of the developing sleeve 205 in the region thereof from the position corresponding to the magnet $S_3$, the position at which to pick up the developer, to the position facing the doctor blade 206, so that the developer brush formed at the position corresponding to the magnet $N_2$ is pushed upstream for separation. That is, the above-mentioned object is accomplished by considering various factors together, such as the magnetic force and the arrangement of the magnets in the magnet roller, the shape and position of the limiting means 9, and also the shape and position of the elongated opening 10*a* formed in the guide portion 10. Generally, since the developer brush formed on the surface of the developing sleeve 205 is affected by the lines of magnetic force from the magnets in the magnet roller, the brush erects in the surface regions of the developing sleeve 205 that are positioned opposite the magnetic poles, but no erected brush is formed in the surface regions between the magnetic poles, which is a well-known phenomenon.

The arrangement of the magnet $N_2$ in the magnet roller will be described in further detail.

As shown in FIG. 5(*a*), the magnet $N_2$ is positioned slightly upstream of the limiting means 9 and directly opposite the elongated opening 10*a*.

Usually, the area that the erected brush formed on the surface of the developing sleeve 205 occupies in space exists at positions opposite the magnetic poles, as described above.

More strictly, the area that the erected brush occupies in space when the developing sleeve 205 is rotating differs from that when it is not rotating.

That is, compared to the area formed when the developing sleeve 205 is stationary, during the rotation of the developing sleeve 205 the whole area is slightly displaced downstream along the surface of the developing sleeve 205 in the rotating direction thereof.

In the present embodiment, provisions are made by also taking this phenomenon into account so that the developer brush is formed more effectively during the rotation of the developing sleeve 205.

Accordingly, as an alternative embodiment, if the developer brush is not limited by the limiting means 9 when the developing sleeve 205 is stationary, it is possible to provide the above effect by constructing the apparatus so that the brush is limited by the limiting means 9 during the rotation of the developing sleeve 205.

During the rotation of the developing sleeve 205, the tip of the developer brush is so formed as to rise to the highest extended portion through the elongated opening 10*a* on the upstream side of the limiting means 9, the tip portion being separated from the developer brush.

This provides the effect of increasing the amount of the tip portion to be removed from the developer brush.

In this manner, from the magnetic brush 701 containing old toner particles that tend to remain adhering to the surface of the developing sleeve 205, the tip portion 701*a* where the mixing ratio of such toner particles is relatively high is forcibly separated and is mixed again into the circulating developer. This not only achieves effective mixing of the developer, but prevents old toner particles from remaining attached to and becoming difficult to separate from the surface of the developing sleeve 205. Copy quality degradation is thus prevented.

In the above embodiment, the developing apparatus 6 has been described as a recirculating-type apparatus, but it will be appreciated that the developer transport method is not limited to any particular method or type.

Figure 6:
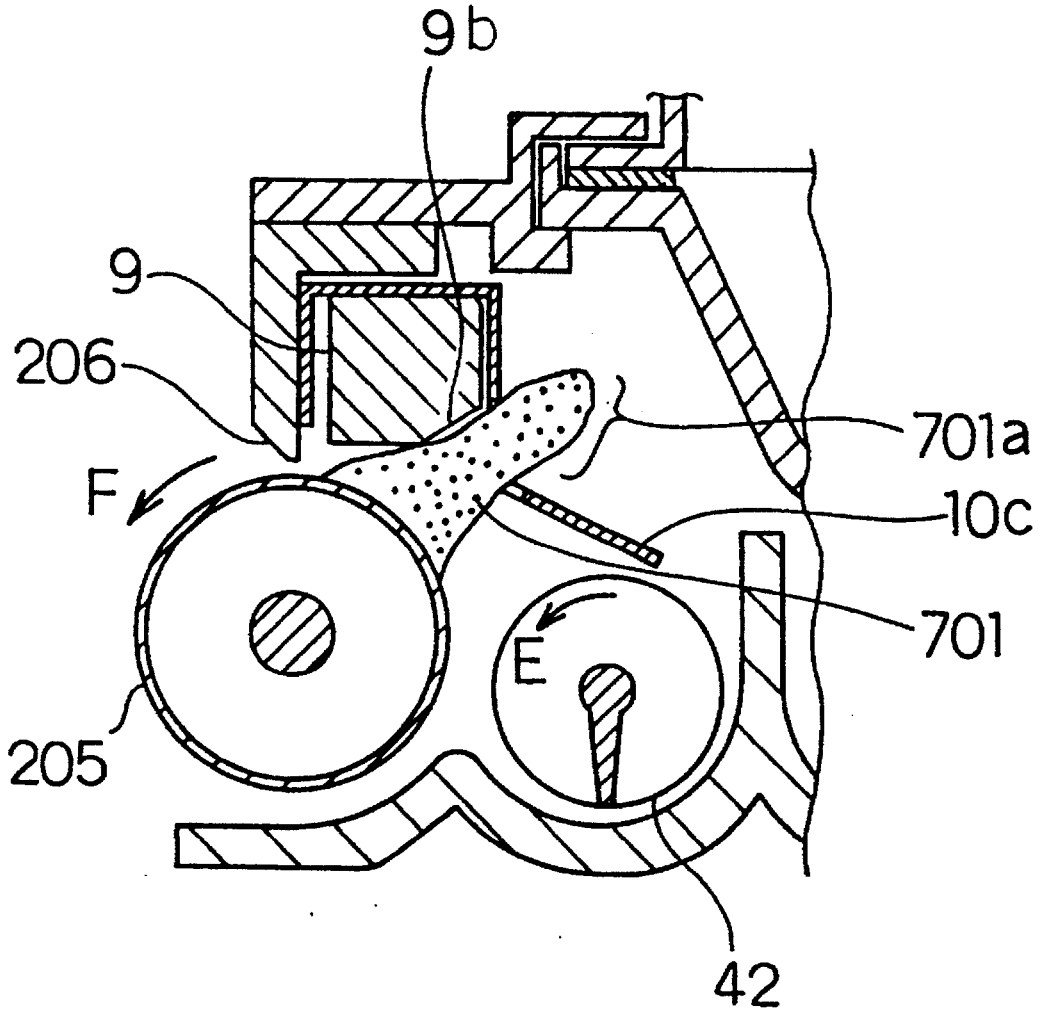
[FIG. 6]

Further, the above embodiment has dealt with an example in which the limiting means 9 is provided with a step 9*a*, but the invention is not limited to the illustrated example. For example, the limiting means 9 may be provided with a sloped face 9*b* of prescribed shape instead of the step 9*a*. FIG. 6 shows an example of one such construction in which the right-hand corner of the bottom face of the limiting means 9, as viewed facing the figure, is chamfered to form the sloped face 9*b*. This sloped face 9*b* slopes upward to the right in the figure with reference to the horizontal portion of the bottom face of the limiting means 9. The sloped face 9*b* is so formed as to provide a similar effect to that described for the step 9*a*.

Figure 7A:
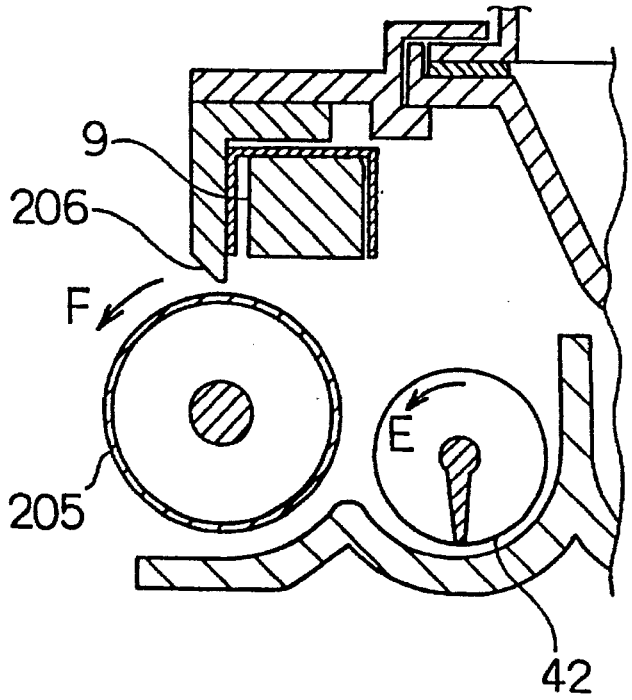
[FIG. 7] FIG. 7(*a*) is a cross-sectional view showing a limiting means having no steps and its adjacent parts in a developing apparatus in which only the limiting means having no steps is provided as developer brush control means, and FIG. 7(*b*) is a cross-sectional view showing the limiting means having no steps and its adjacent parts in a developing apparatus in which the limiting means having no steps and a guide member are provided as developer brush control means.
Figure 7B:
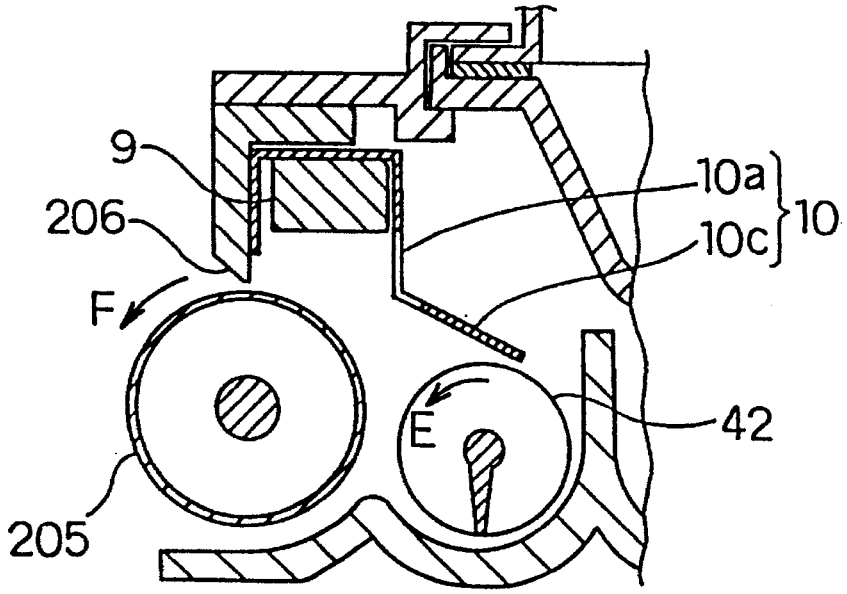

Also, the above embodiment has dealt with an example in which the limiting means 9 has the step 9*a* and the guide end portion 10*c* is provided, but the invention is not limited to the illustrated example. For example, the guide end portion as the guide member in the present invention may be omitted, as shown in FIG. 7(*a*); alternatively, as shown in FIG. 7(*b*), the limiting means may not be provided with a step on the developing sleeve side thereof. In either construction, the tip portion 701*a* of the magnetic brush can be separated forcibly for mixing again into the circulating developer. By repeating this process, it is possible to prevent old toner particles from remaining attached to and becoming difficult to separate from the surface of the developing sleeve 205. This prevents degradation of copy quality. Here, FIG. 7(*a*) is a cross-sectional view showing the limiting means and its adjacent parts in the developing apparatus in which the limiting means having no steps is incorporated but the guide member is omitted; FIG. 7(*b*) is a cross-sectional view showing the limiting means and its adjacent parts in the developing apparatus in which both the limiting means having no steps and the guide member are incorporated.

It will also be recognized that the present invention is applicable not only to copying machines but to other types of image forming apparatus, such as a printer, a facsimile machine, and the like, incorporating a developing apparatus.

As is apparent from the above description, the present invention has the advantage that degradation of copy quality can be prevented more effectively than the prior art.

What is claimed is:

1. A developing apparatus comprising:

a developing sleeve for supplying toner to a photoconductor surface, said developing sleeve containing a stationary magnet roller having magnetic poles which are arranged such that an erected developer brush is formed on said developing sleeve;

a brush-thickness control member disposed in close proximity to a surface of said developing sleeve, for controlling a thickness of a developer brush formed on said developing sleeve;

limiting means for limiting advance of a tip of said erected developer brush by pushing said tip toward an upstream side with reference to a rotating direction of said developing sleeve, and for separating at least a portion of said tip from said erected developer brush with rotation of said developing sleeve, said limiting means being disposed adjacent to and upstream of said brush-thickness control member, and disposed downstream of a position on said developing sleeve where said erected developer brush is formed by said magnet roller when said developing sleeve is stationary; and a guide member for receiving at least a portion of developer from said tip separated from said erected developer brush and for guiding said developer from said tip away from said developing sleeve, said guide member being positioned below said limiting means.

2. A developing apparatus according to claim 1, wherein said magnet roller has a magnetic pole positioned substantially opposite said position on said developing sleeve where said erected developer brush is formed by said magnet roller when said developing sleeve is stationary.

3. A developing apparatus according to claim 2, wherein said guide member is positioned upstream of said magnetic pole.

4. A developing apparatus according to claim 1, further including a transport screw provided adjacent to said developing sleeve for mixing and transporting developer in an axial direction of said developing sleeve, said transport screw having a first side facing said developing sleeve and a second side opposite said first side, wherein said guide member has an end portion extending to a position above said second side of said transport screw.

5. A developing apparatus according to claim 1, wherein said limiting means is formed of an ABS resin and said guide member is formed of stainless steel.

6. A developing apparatus according to claim 1, wherein said limiting means has a step formed on a side thereof facing said developing sleeve, or a sloped face sloping upward toward said upstream side, said step or said sloped face being provided to increase an amount of developer from said tip separated in said erected developer brush.

7. A developing apparatus according to claim 1, wherein said guide member includes a mounting portion for mounting said limiting means and a guide portion for guiding said developer from said tip separated from said erected developer brush away from said developing sleeve, and wherein said guide member defines an opening between said mounting portion and said guide portion, for allowing formation of said erected developer brush on said upstream side of said limiting means, between said mounting portion and said guide portion.

8. A developing apparatus according to claim 7, wherein a longitudinal direction of said guide member is substantially parallel to an axial direction of said developing sleeve, and said opening is formed so that a length thereof measured along said longitudinal direction is substantially equal to a length of said developing sleeve measured along said axial direction.

9. A developing apparatus according to claim 7, wherein said magnet roller has a magnetic pole positioned substantially opposite said position on said developing sleeve where said erected developer brush is formed by said magnet roller when said developing sleeve is stationary.

10. A developing apparatus according to claim 9, wherein said opening in said guide member is formed substantially opposite said magnetic pole of said magnet roller.

11. A developing apparatus comprising:

a developing sleeve for supplying toner to a photoconductor surface;

a brush-thickness control member disposed in close proximity to a surface of said developing sleeve;

limiting means, disposed adjacent to and on an upstream side of said brush-thickness control ember with reference to a rotating direction of said developing sleeve, for limiting advance of a tip of an erected developer brush by pushing said tip toward said upstream side, and for separating at least a portion of said tip from said erected developer brush with rotation of said developing sleeve; and a guide member for receiving at least a portion of developer from said tip separated from said erected developer brush and for guiding said developer from said tip away from said developing sleeve, said guide member being disposed below said limiting means.

12. A developing apparatus according to claim 11, further including a transport screw provided for mixing and transporting said developer in an axial direction of said developing sleeve, said transport screw having a first side facing said developing sleeve and a second side opposite said first side, wherein said guide member has an end portion formed adjacent to said developing sleeve and extending to a position above said second side of said transport screw.

13. A developing apparatus according to claim 11, wherein said limiting means is formed of an ABS resin and said guide member is formed of stainless steel.

14. A developing apparatus according to claim 11, wherein said limiting means has a step formed on a side thereof facing said developing sleeve, or a sloped face sloping upward toward said upstream side, said step or said sloped face being provided to increase an amount of developer from said tip separated in said erected developer brush.

15. A developing apparatus according to claim 11, wherein said guide member includes a mounting portion for mounting said limiting means and a guide portion for guiding said developer from said tip separated from said erected developer brush away from said developing sleeve, and wherein said guide member defines an opening between said mounting portion and said guide portion, for allowing formation of said erected developer brush on said upstream side of said limiting means, between said mounting portion and said guide portion.

16. A developing apparatus according to claim 15, wherein a longitudinal direction of said guide member is substantially parallel to an axial direction of said developing sleeve, and said opening is formed so that a length thereof measured along said longitudinal direction is substantially equal to a length of said developing sleeve measured along said axial direction.

* * * * *